US012638257B1

(12) United States Patent
Enderle et al.

(10) Patent No.: US 12,638,257 B1
(45) **Date of Patent: *May 26, 2026**

(54) DART LAUNCH APPARATUS WITH AN OPEN TOP MAGAZINE AND A DART RESTRAINER IN THE LAUNCH CHAMBER AND METHOD

(71) Applicant: Hasbro, Inc., Pawtucket, RI (US)

(72) Inventors: Alyssa Enderle, Providence, RI (US); Dennis Bernal, West Warwick, RI (US); Brian Jablonski, Providence, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/946,270

(22) Filed: Nov. 13, 2024

Related U.S. Application Data

(63) Continuation of application No. 18/082,418, filed on Dec. 15, 2022, now Pat. No. 12,146,720.

(60) Provisional application No. 63/292,264, filed on Dec. 21, 2021.

(51) Int. Cl.
*F41A 9/61* (2006.01)
*F42B 6/00* (2006.01)

(52) U.S. Cl.
CPC ..... *F41A 9/61* (2013.01); *F42B 6/003* (2013.01)

(58) Field of Classification Search
CPC .. F41B 7/006; F41B 7/003; F41B 7/08; F41B 11/50; F41B 11/89; F41B 11/55; F41B 11/57; F41B 11/71; F41B 4/00; F41A 17/48; F41A 19/10
USPC ..... 42/54
See application file for complete search history.

(56) References Cited

U.S. PATENT DOCUMENTS

| | | | |
|---|---|---|---|
| 46,617 | A | 3/1865 | Allen |
| 159,609 | A | 2/1875 | Prescott |
| 956,760 | A | 5/1910 | Moulin |
| 1,441,975 | A | 1/1923 | Edelin |
| 1,488,995 | A | 4/1924 | McCollom |
| 1,995,493 | A | 3/1935 | Ardiff |
| 2,737,942 | A | 3/1956 | Horowitz et al. |
| 3,054,536 | A | 9/1962 | Sagarin |
| 3,171,020 | A | 2/1965 | Lord |
| 3,262,440 | A | 7/1966 | Kuhn |
| 3,420,133 | A | 1/1969 | Proll |
| 3,990,426 | A | 11/1976 | Stokes |
| 4,597,527 | A | 7/1986 | Sands |
| 4,774,929 | A | 10/1988 | Millman |
| 4,841,945 | A | 6/1989 | Braden |
| 4,890,404 | A | 1/1990 | Ferri |
| 5,205,271 | A | 4/1993 | Salva |

(Continued)

*Primary Examiner* — John Cooper
(74) *Attorney, Agent, or Firm* — Perry Hoffman

(57) ABSTRACT

A dart launcher and dart magazine for alleviating improper dart placement concerns with a forward matching dart profile. The dart magazine is short and does not extend into the launch chamber of the launcher. The magazine has an open top with a dart restrainer that is moved when the magazine is inserted into the launcher causing an upper-most dart in the magazine to be biased out of the magazine and into the launch chamber. The launcher includes a dart placement structure in the launch chamber to locate the upper-most dart. The dart placement structure may be shaped as an arm allowing positioning of each dart also free of the magazine while facilitating automatic firing of the darts from the magazine.

20 Claims, 19 Drawing Sheets

(56) References Cited

U.S. PATENT DOCUMENTS

| | | | | |
|---|---|---|---|---|
| 5,244,153 | A | 9/1993 | Kuhn et al. | |
| 5,267,549 | A | 12/1993 | Webber | |
| 5,320,207 | A | 6/1994 | Abe | |
| 5,337,504 | A | 8/1994 | Krumm | |
| 5,343,850 | A | 9/1994 | Steer | |
| 5,471,967 | A | 12/1995 | Matsuzaki et al. | |
| 5,529,050 | A | 6/1996 | D'Andrade | |
| 5,535,729 | A | 7/1996 | Griffin et al. | |
| 5,704,150 | A | 1/1998 | Millman | |
| 5,878,734 | A | 3/1999 | Johnson et al. | |
| 6,119,671 | A | 9/2000 | Smith et al. | |
| 6,488,019 | B2 | 12/2002 | Kotsiopoulos | |
| 7,017,569 | B2 | 3/2006 | Jong | |
| 7,051,727 | B2 | 5/2006 | Wu | |
| 8,082,909 | B2 | 12/2011 | Sopinsky et al. | |
| 8,113,188 | B2 | 2/2012 | Ma | |
| 8,127,753 | B1 | 3/2012 | Brooks et al. | |
| 8,127,754 | B1 | 3/2012 | Johnson et al. | |
| 8,336,531 | B2 | 12/2012 | Fan et al. | |
| 8,397,705 | B2 | 3/2013 | DeHaan et al. | |
| 8,567,378 | B2 | 10/2013 | Nugent | |
| 8,695,579 | B2 | 4/2014 | Huebl | |
| 8,875,688 | B2 | 11/2014 | Nugent | |
| 8,875,689 | B2 | 11/2014 | Chor-Ming | |
| 9,097,476 | B2 | 8/2015 | Mead et al. | |
| 9,097,477 | B1 | 8/2015 | Mead et al. | |
| 9,389,042 | B1 | 7/2016 | Clayton | |
| 9,500,436 | B2 | 11/2016 | Macy | |
| 9,587,903 | B2 * | 3/2017 | Sullivan | F41B 11/52 |
| 9,952,016 | B2 | 4/2018 | Sullivan | |
| 9,958,230 | B1 | 5/2018 | Nugent et al. | |
| 10,094,630 | B1 | 10/2018 | Loveday et al. | |
| 10,488,143 | B2 | 11/2019 | Victor et al. | |
| 10,488,148 | B2 | 11/2019 | Johnson et al. | |
| 10,823,527 | B2 | 11/2020 | Tino et al. | |
| 10,876,809 | B1 | 12/2020 | Kopman et al. | |
| 10,907,929 | B2 | 2/2021 | Bernal | |
| 11,033,805 | B2 | 6/2021 | Bernal | |
| 11,466,958 | B2 | 10/2022 | Bernal | |
| 11,953,286 | B1 * | 4/2024 | Enderle | F41A 17/48 |
| 2002/0166551 | A1 | 11/2002 | Lee | |
| 2004/0123856 | A1 | 7/2004 | Finstad | |
| 2009/0095272 | A1 | 4/2009 | Zimmerman | |
| 2010/0206281 | A1 | 8/2010 | Kanitz et al. | |
| 2013/0112184 | A1 | 5/2013 | Corsiglia et al. | |
| 2013/0312722 | A1 | 11/2013 | Price | |
| 2014/0130787 | A1 * | 5/2014 | Macy | F41B 11/55 124/73 |
| 2016/0018184 | A1 | 1/2016 | Park | |
| 2019/0107358 | A1 * | 4/2019 | Spielberger | F41B 7/006 |
| 2020/0309482 | A1 * | 10/2020 | Bernal | F41B 11/64 |
| 2022/0268550 | A1 | 8/2022 | Bernal | |

* cited by examiner

DART LAUNCH APPARATUS WITH AN OPEN TOP MAGAZINE AND A DART RESTRAINER IN THE LAUNCH CHAMBER AND METHOD

PRIORITY CROSS-REFERENCE TO RELATED APPLICATIONS

This application is a Continuation of U.S. patent application Ser. No. 18/082,418 filed Dec. 15, 2022, now U.S. Pat. No. 12,146,720 to issue Nov. 19, 2024, and claims priority pursuant to 35 U.S.C. 119(e) from U.S. Provisional Patent Application No. 63/292,264 filed Dec. 21, 2021.

FIELD OF THE INVENTION

The present invention relates generally to a dart launch apparatus and a magazine, and more particularly, to a dart launch apparatus having a magazine with an open top that transfers a dart from the magazine into a launch chamber of the dart launch apparatus when the magazine is inserted into the launch apparatus. The launch apparatus also includes a dart placement structure in the launch chamber to receive and position the transferred dart.

BACKGROUND OF THE INVENTION

Various launch apparatus are known in the prior art. For example, the following six U.S. patents, all assigned to the assignee of the present application, illustrate battery operated rapid discharge dart launchers: U.S. Pat. Nos. 9,097,476 and 9,097,477 issued in 2015 to inventors Mead, Jablonski and Falkowski II; U.S. Pat. No. 9,958,230 issued in 2018 to inventors Nugent and Keska; U.S. Pat. No. 10,488,143 issued in 2019 to inventors Victor, Miller, Yuan, Falkowski II, Lallier, and King; U.S. Pat. No. 10,876,809 issued in 2020 to inventors Kopman, Miller and Victor; and U.S. Pat. No. 10,907,929 issued in 2021 to inventor Bernal. The last mentioned patent relates to the new dart described below.

Prior art dart launch apparatus tend to have dart placement and possible jamming or improper firing concerns especially with worn, damaged or bent darts. The inventive dart launch apparatus and magazine should alleviate this problem.

SUMMARY OF THE INVENTION

The inventive dart launch apparatus or launcher is simply constructed and provides that a dart from the magazine leaves the magazine and enters a chamber in the launcher so that the dart avoids snagging or getting caught by components of the magazine. The top portion of the magazine is shorter than prior art magazines and a dart is transferred from the magazine to the launcher when the magazine is inserted into the launcher. Thereafter, the upward bias in the magazine forces a new dart to leave the magazine when a previous dart in the launcher has discharged.

Briefly summarized, the invention relates to a dart launch apparatus including an outer housing, the outer housing having an opening to receive a dart magazine and a launch chamber located at the opening, an energy source mounted in the outer housing for launching a dart, a trigger mounted to the outer housing for causing a dart to be launched, a cam rib in the outer housing positioned between the launch chamber and the dart magazine opening, a dart magazine removably mounted to the outer housing through the opening in the outer housing, the dart magazine including a housing having an open top, a dart restrainer pivotally mounted to the magazine housing, the dart restrainer being moved or pivoted by the cam rib when the dart magazine is inserted through the opening in the outer housing, and a dart placement structure within the launch chamber for receiving an upper-most dart from the dart magazine when the dart magazine is inserted into the outer housing. The invention also relates to a dart magazine for operating with the dart launch apparatus, the magazine including a magazine housing for receiving a plurality of darts, the magazine housing having two sidewalls, a front wall, a rear wall, a bottom wall and an open top, a dart follower movable in the magazine housing, a spring structure positioned between the bottom wall and the dart follower for biasing darts in the magazine housing to the open top, and a dart restrainer pivotally mounted to the magazine housing for blocking a dart moving through the open top when the magazine housing is separated from the dart launch apparatus and for unblocking a dart moving through the open top when the dart magazine is inserted into the dart launch apparatus wherein an unblocked dart leaves the dart magazine and is biased into the launch chamber.

The invention also relates to a method for making a dart launch apparatus including the steps of forming an outer housing, the outer housing having a launch chamber and an opening to receive a dart magazine, providing an energy source mounted within the outer housing for launching a dart, mounting a trigger to the outer housing, forming a cam arm positioned within the outer housing, providing a dart magazine for mounting to the outer housing, the mounted dart magazine being located below the launch chamber, and having an open top, mounting a dart restrainer to the dart magazine for blocking darts loaded in the dart magazine from exiting wherein upon insertion of the dart magazine into the outer housing the cam rib causes an upper-most dart to leave the dart magazine and enter the launch chamber, and forming a dart placement structure in the launch chamber of the launch apparatus for receiving the upper-most dart from the dart magazine.

BRIEF DESCRIPTION OF DRAWINGS

For the purpose of facilitating an understanding of the invention, the accompanying drawings and detailed description illustrate preferred embodiments thereof, from which the invention, its structures, its constructions and operations, its processes, and many related advantages may be readily understood and appreciated.

DETAILED DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
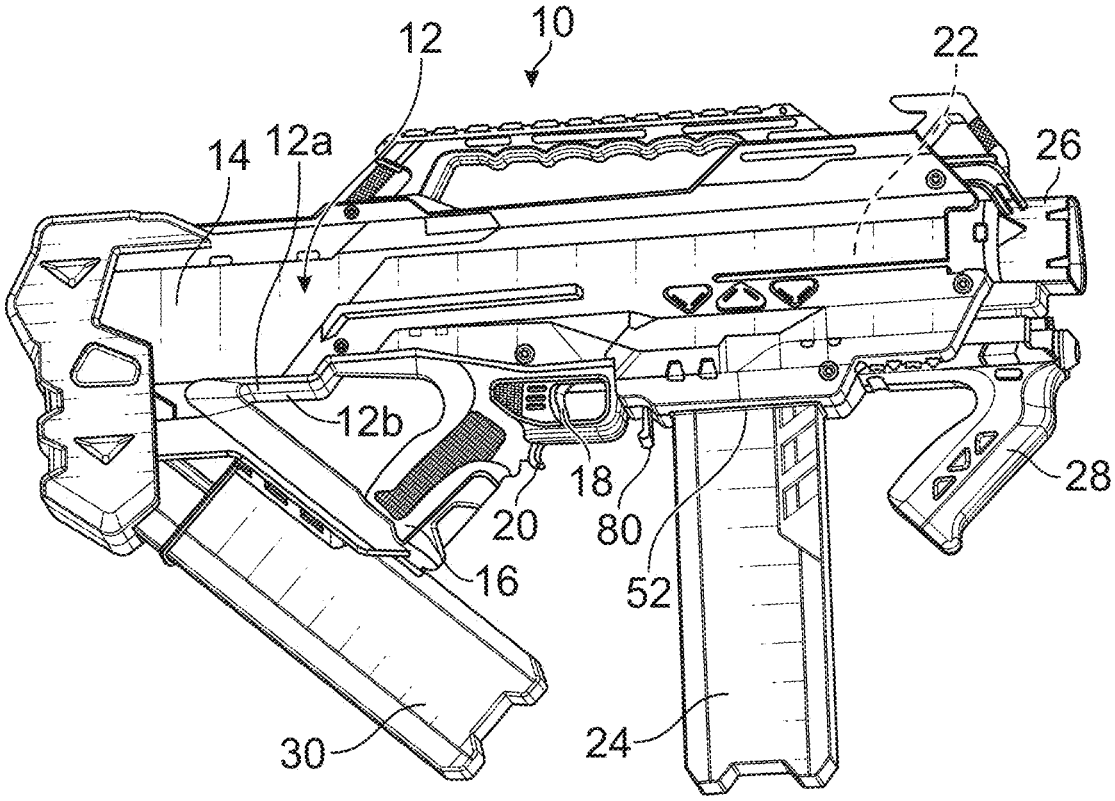
FIG. 1 is a side isometric view of the inventive dart launch apparatus.

The inventive dart launch apparatus or dart launcher 10 may take the highly stylized form shown in FIG. 1. The dart launcher 10 may include an outer housing 12 formed of two complementary parts or halves 12*a* and 12*b*, a stock 14, a grip 16, a launch trigger 18, an internal receiver or launch chamber 22, a clip or dart magazine 24 and a muzzle 26. The dart launcher may also include a second or front grip 28 and an optional second, stored magazine 30.

Figure 2:
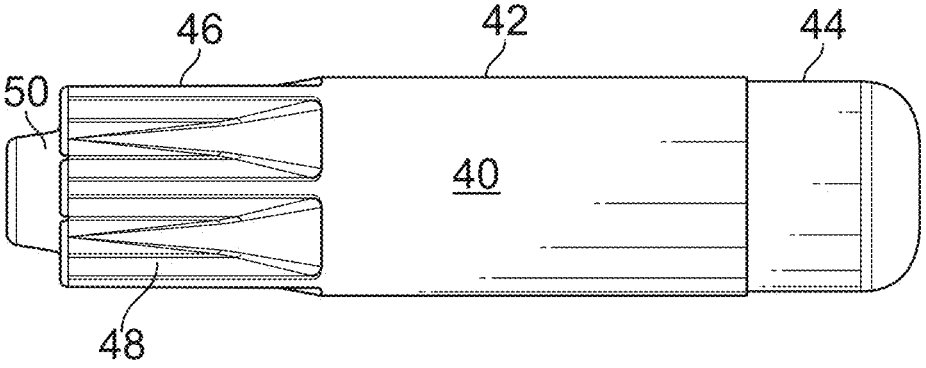
FIG. 2 is an enlarged rear isometric view of a dart used with the dart launch apparatus shown in FIG. 1.

The dart launcher 10 is designed to handle and launch a special projectile or dart 40, FIG. 2, which is disclosed in U.S. Pat. No. 11,033,805 and D904,525 (and elsewhere), both of which are incorporated herein, in full, by reference. The two mentioned patents are assigned to the assignee of the present application. The dart 40 may have a relatively stiff cylindrical body 42 with a softer tip or nose element 44 attached at a front end of the body 42. The rear end portion 46 of the body 42 may include a series of fins, such as the fin 48, and a rearward-protruding nub 50 integral with the body 42. The dart 40 has an outline or taper profile as shown in FIG. 2, and is currently commercially available from Hasbro Inc., of Rhode Island, and is sold under the brand NERF ULTRA®.

Figure 10:
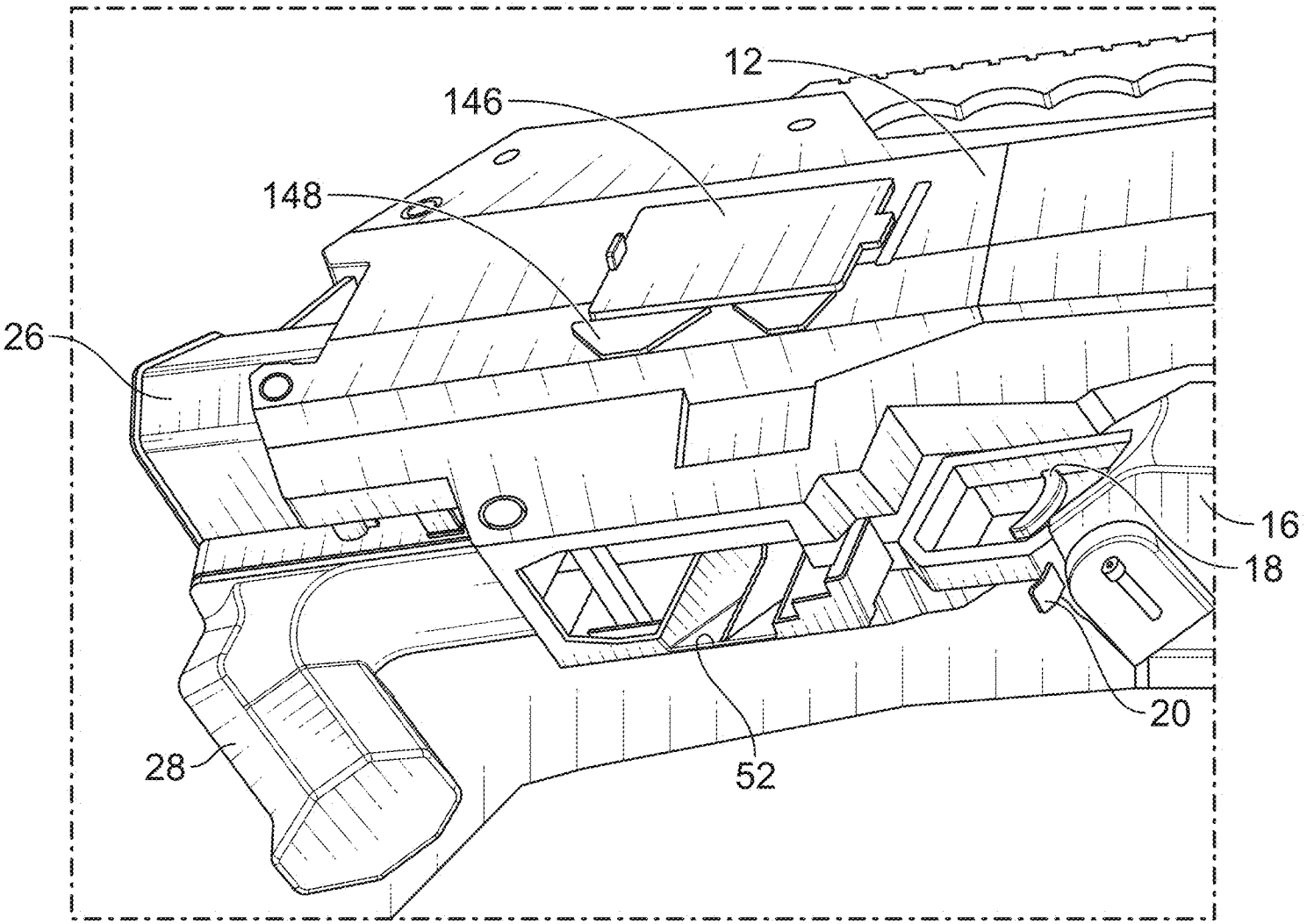
FIG. 10 is a bottom isometric view of the dart launch apparatus shown in FIG. 1, illustrating a bottom opening for receiving the magazine and a side opening for access to a launch chamber.

Mounted to the outer housing 12 of the dart launcher 10 is the dart magazine 24 inserted through a bottom opening 52, FIGS. 1 and 10, in the outer housing 12. The dart magazine 24, FIGS. 3A-5, may include a magazine, clip or drum housing 60 for stacking one or more darts. The magazine may have two sidewalls 62, 64, a front wall 66, a rear wall 68, a bottom wall 70 and an open top 72. Within the housing 60 may be the usual biasing spring structure 74 and a follower 76. The magazine housing may be formed of two complementary halves or parts 60*a* and 60*b* and include a recess 78 in the rear wall 68 to receive a magazine lock 80, FIGS. 1 and 6, mounted to the dart launcher 10, the magazine lock 80 for removably securing the dart magazine 24 to the dart launcher 10. As discussed herein, the open top magazine with a dart restrainer causes the upper-most dart 40 from the magazine to be biased out of the magazine and into the launch chamber. The launcher includes a dart placement structure 152 discussed below in the launch chamber to locate the upper-most dart, and the launch chamber is aligned with a push rod and launch wheels. The dart placement structure may be shaped as a flange or arm allowing positioning of each dart also free of the magazine while facilitating automatic firing of the darts from the magazine. FIGS. 3B-3K illustrate alternate embodiment magazine, clip or drum housing embodiments for use with dart launch apparatus The open top 72 of the dart magazine includes an outline or border structure 82, FIG. 5, around the open top 72, which corresponds to the outline or profile of the dart 40, FIG. 2. The border structure 82 extends downward into the magazine housing to form a slot 84, FIG. 5, having a cross-section that matches the profile taper of the dart 40, including a nub outline 86 of the border structure 82. The improvised projectile (IP) test is facilitated passively within the magazine itself including a profile or nub complementary outline to facilitate automatic firing of darts 40, 40*a*-40*k* when properly placed at the dart placement structure 152 for dart forward orientation placement matching dart profiles used with dart magazines 24, and 24*a*-*k*. The border structure 82 and the slot 84 result in a safety feature for the dart magazine by facilitating the loading of darts in the correct orientation, attitude, or direction, and preventing the positioning of improvised projectiles as non-mechanical IP detection, with the nub 50 of the dart 40, or 40*a*-40*k* fitting within nub outlines 86, 86*a*-86*k* of the border structure 82. Attempting to load a dart with the nub facing forward will squeeze and distort the dart and make loading of darts difficult, if not impossible. Attempting to load other objects not having the correct outline will also prove difficult, if not impossible, because of the border structure 82 at the open top 72 of the magazine 24.

Another advantage of the dart magazine 24 is that the border structure 82 and the magazine slot 84 may be easily altered so that darts having new designs may be accommodated without any change in the structure of the dart launcher 10. As disclosed herein, the placement structure 152 profile may be altered to accommodate a variety of differently shaped contoured dart profile such as squared or rectangular, keyed, grooved or ribbed profiles, enlarged head or non-circular arrangements as illustrated, e.g, in FIGS. 3B-3K as alternate dart profiles with corresponding dart magazine embodiments.

Figure 6:
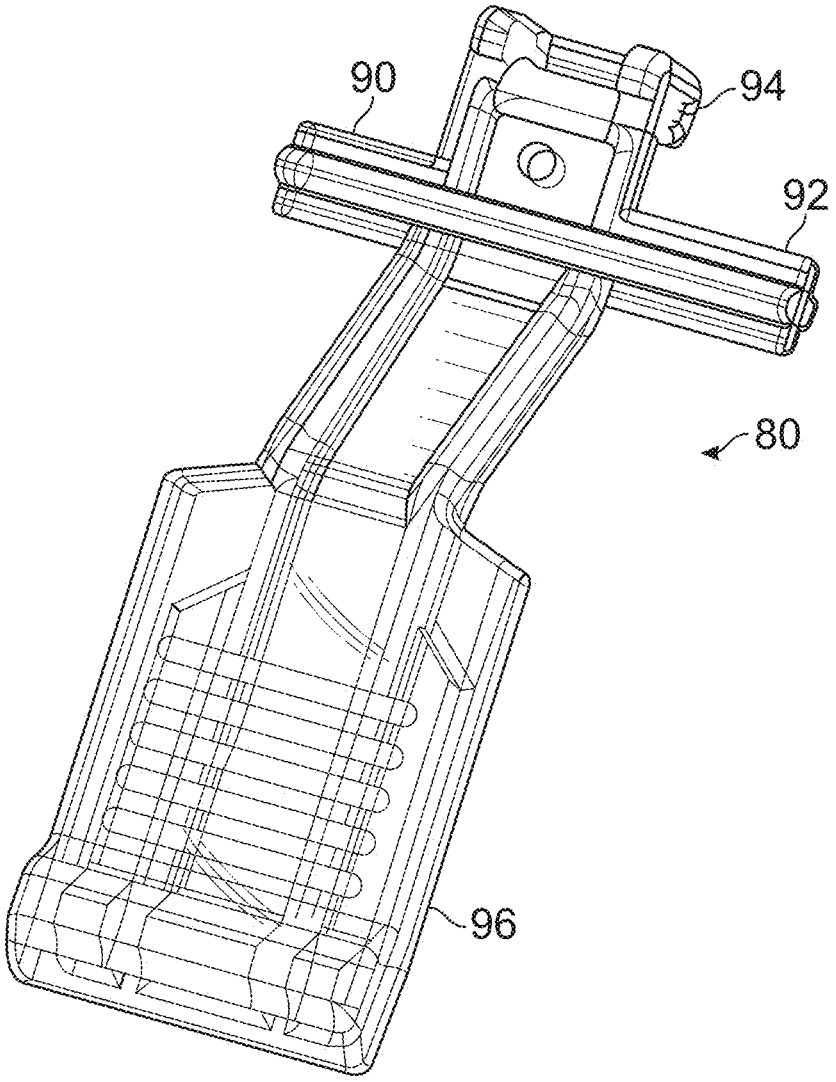
FIG. 6 is an enlarged isometric view of a magazine lock used in the dart launch apparatus shown in FIG. 1.

The magazine lock 80, FIG. 6, is spring biased and includes two pivot shafts 90, 92, a latch head 94 and a release lever 96. The magazine lock 80 pivots rearward away from the rear wall 68 of the magazine 24 when an operator inserts the magazine into the dart launcher 10. When the latch head 94 is aligned with the recess 78, FIG. 4, in the magazine, the magazine lock 80 pivots forward, rotating at pivot shafts 90, 92 away from the rear wall 68 so that the latch head 94 engages into the recess and secures the magazine. When the operator desires to release and reload the magazine, the release lever 96 may be depressed to remove the latch head 94 from the recess 78 to allow the operator to remove the magazine.

Figure 3A:
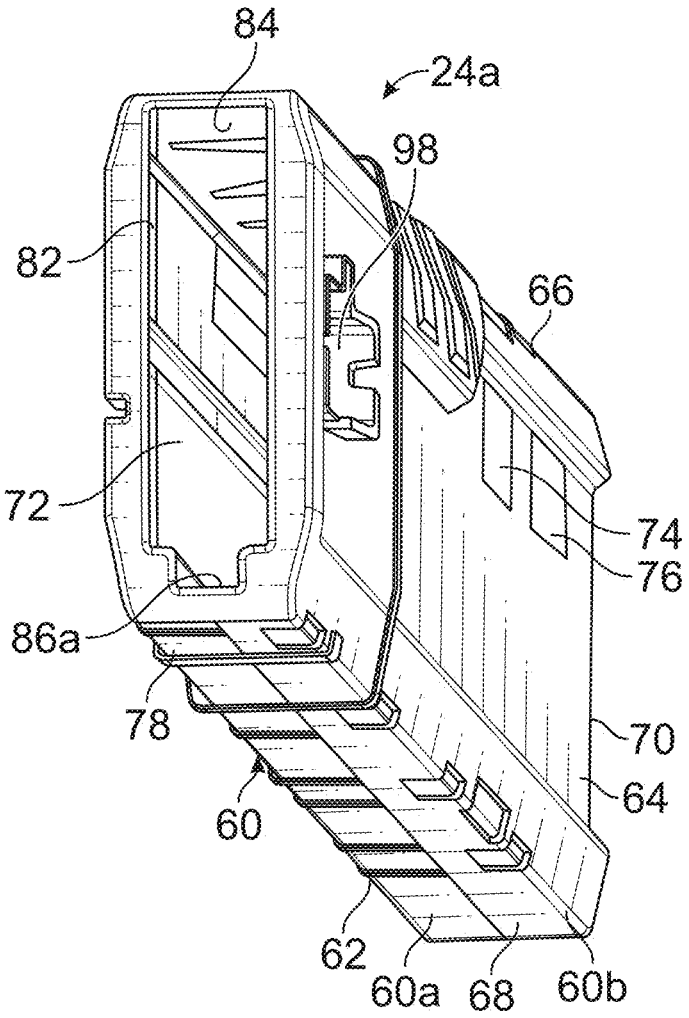
FIG. 3A is a downward looking isometric view of a dart magazine used with the dart launch apparatus shown in FIG. 1, and FIGS. 3B-3K are alternate embodiment views of dart magazine embodiments used with the dart launch apparatus in accordance with the described inventions.
Figure 3B:
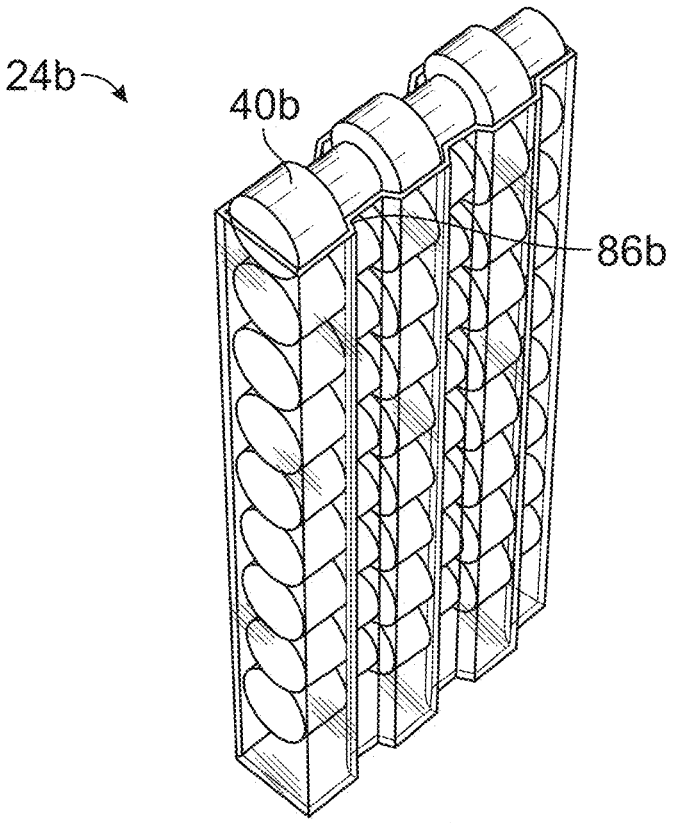
Figure 3C:
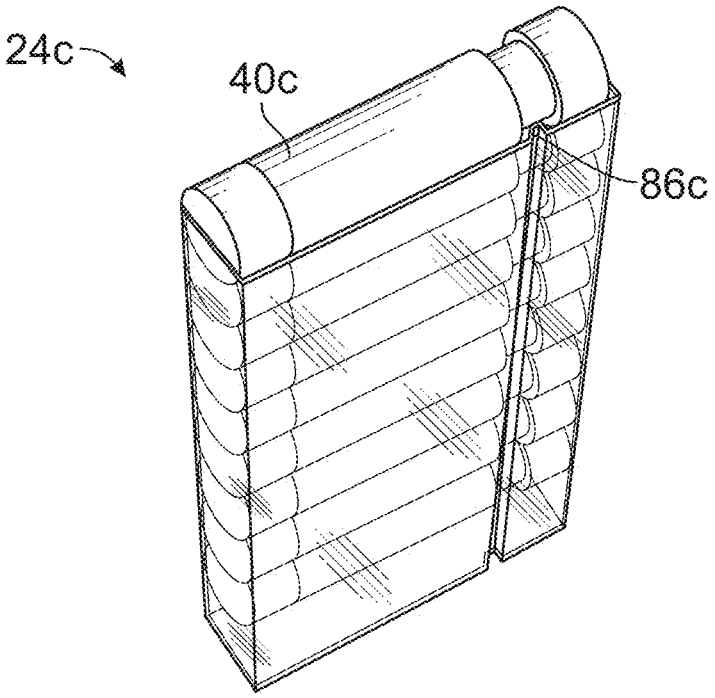
Figure 3D:
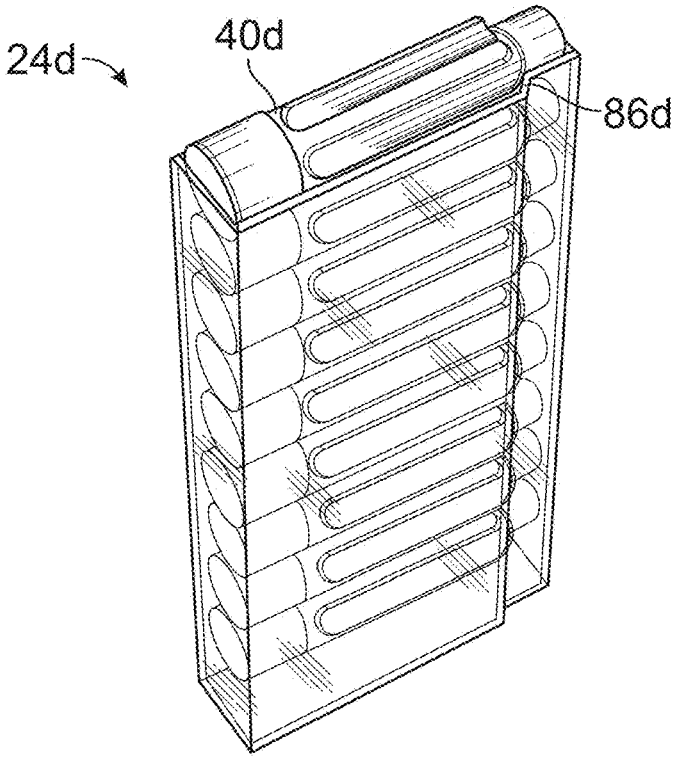
Figure 3E:
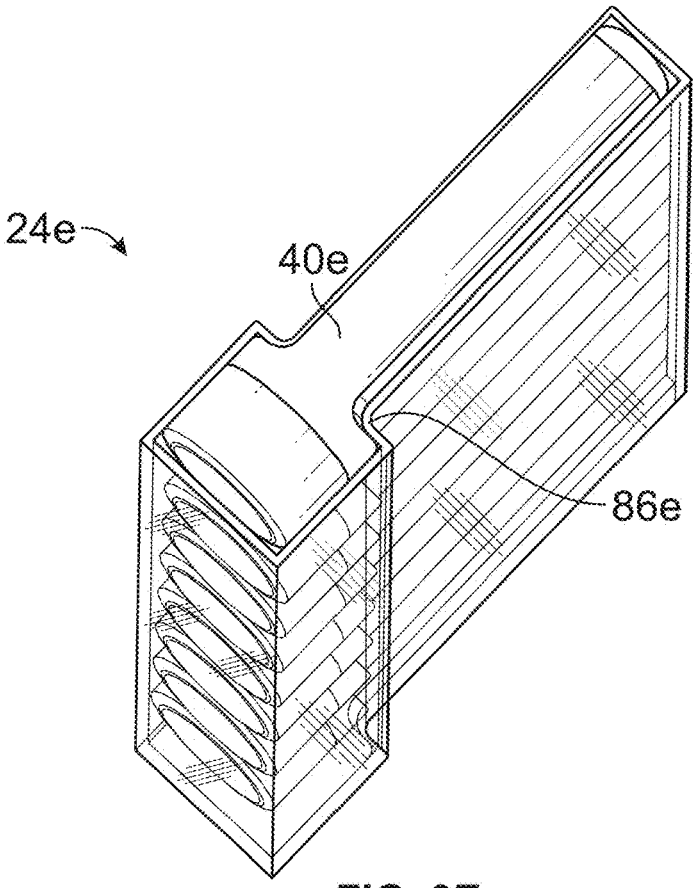
Figure 3F:
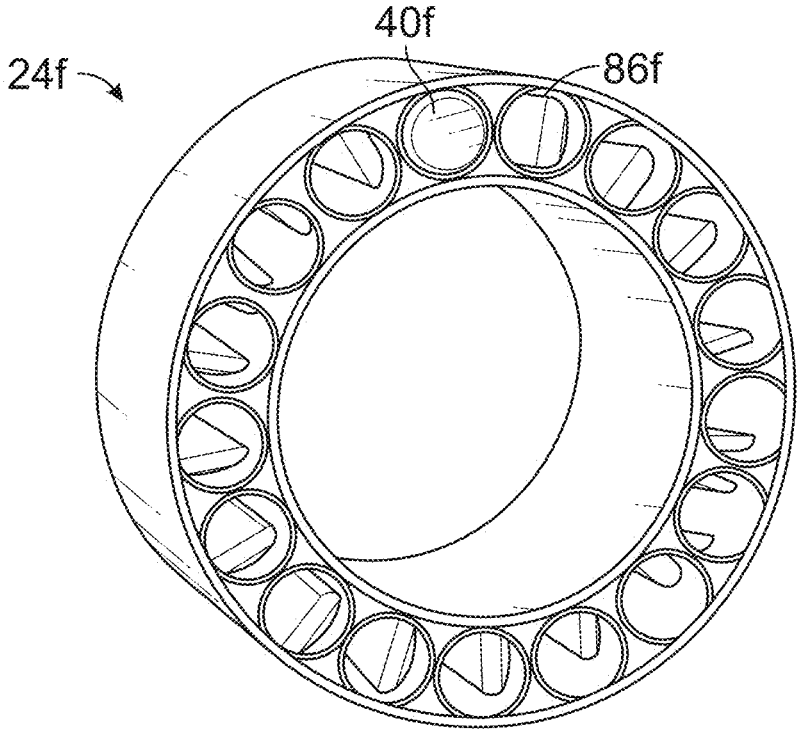
Figure 3G:
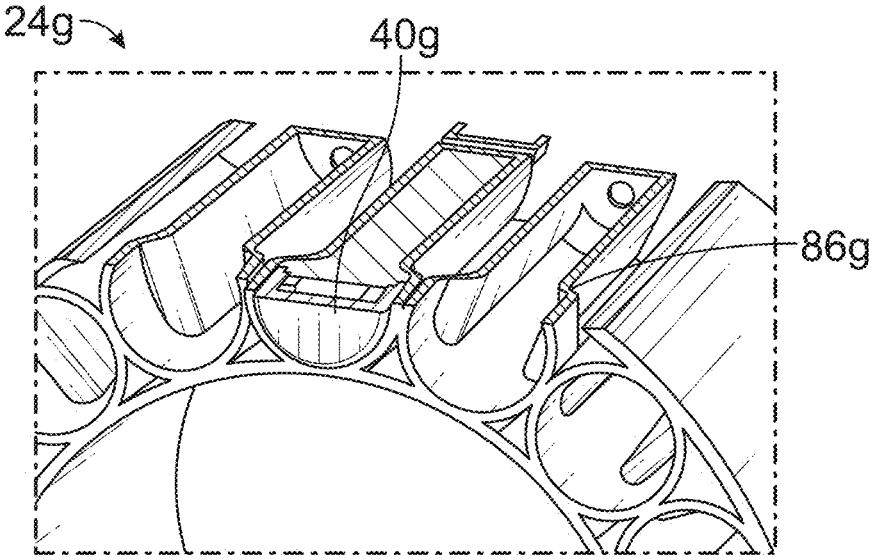
Figure 3H:
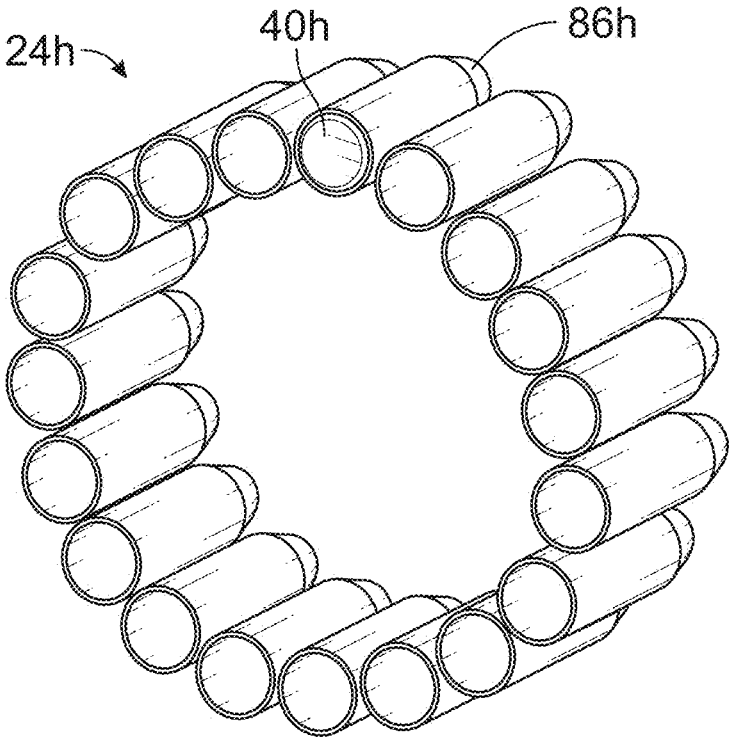
Figure 3I:
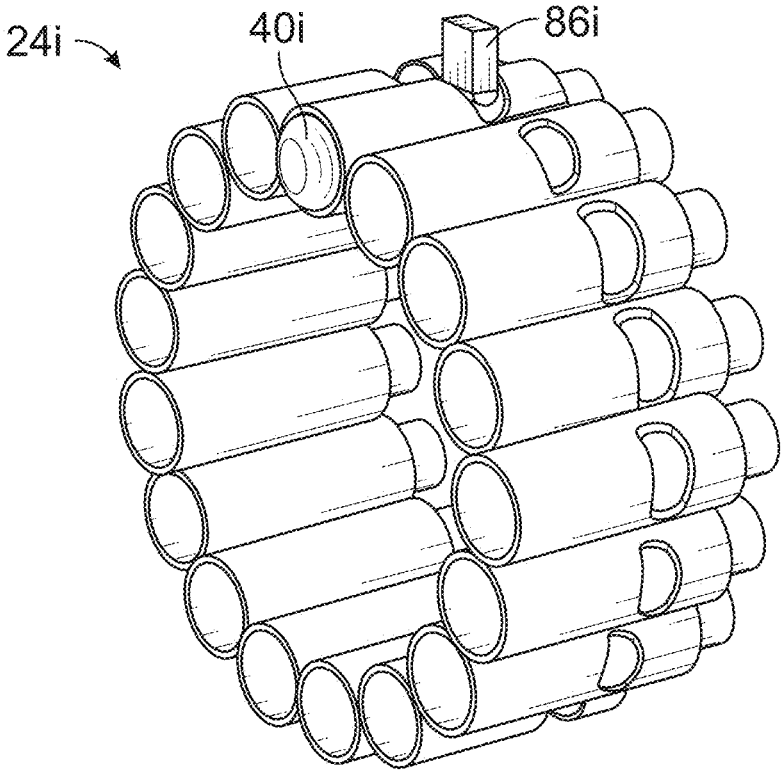
Figure 3J:
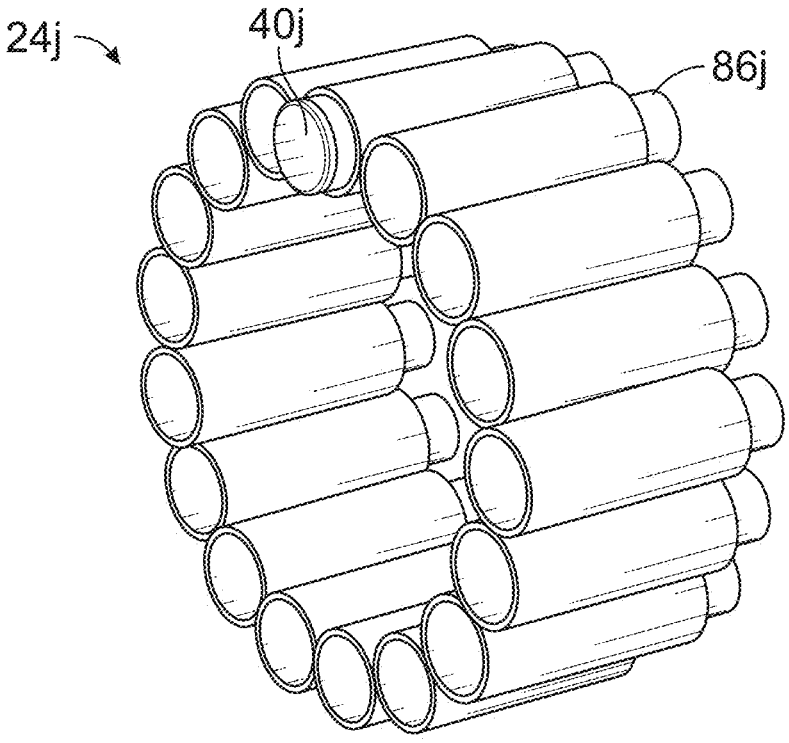
Figure 3K:
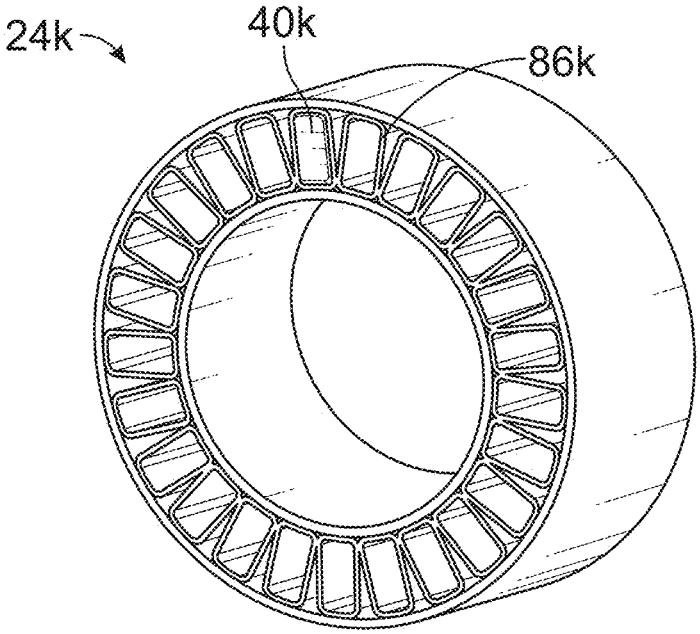
Figure 5:
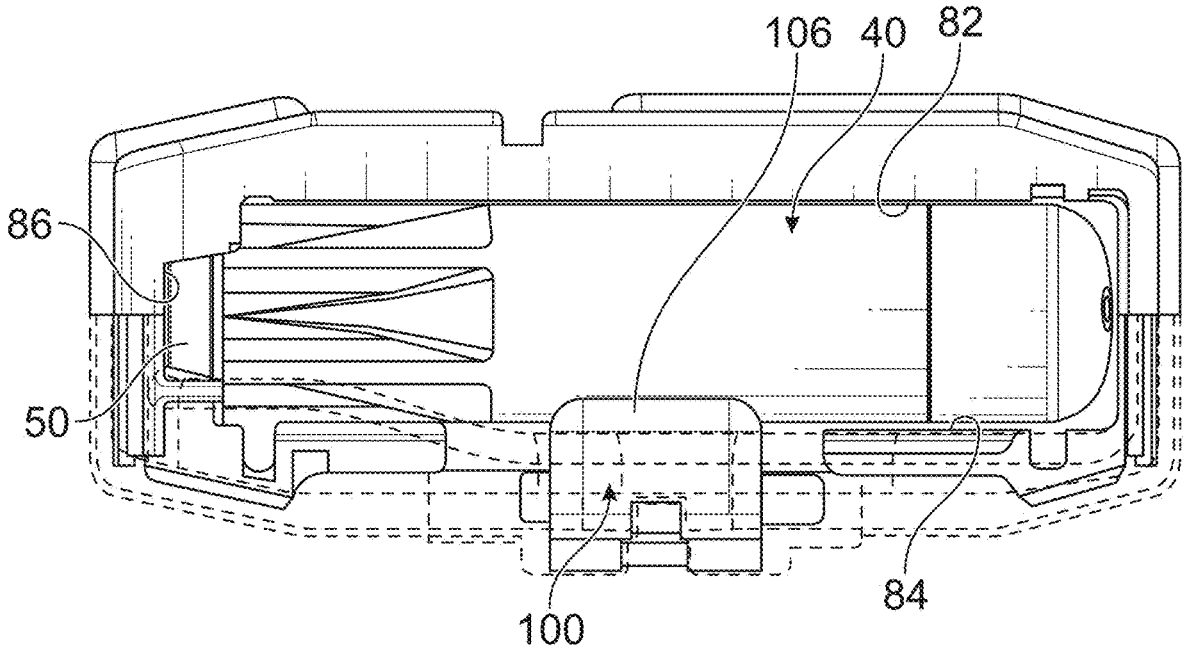
FIG. 5 is a cross-sectional view taken along line 5-5 of FIG. 4.
Figure 7:
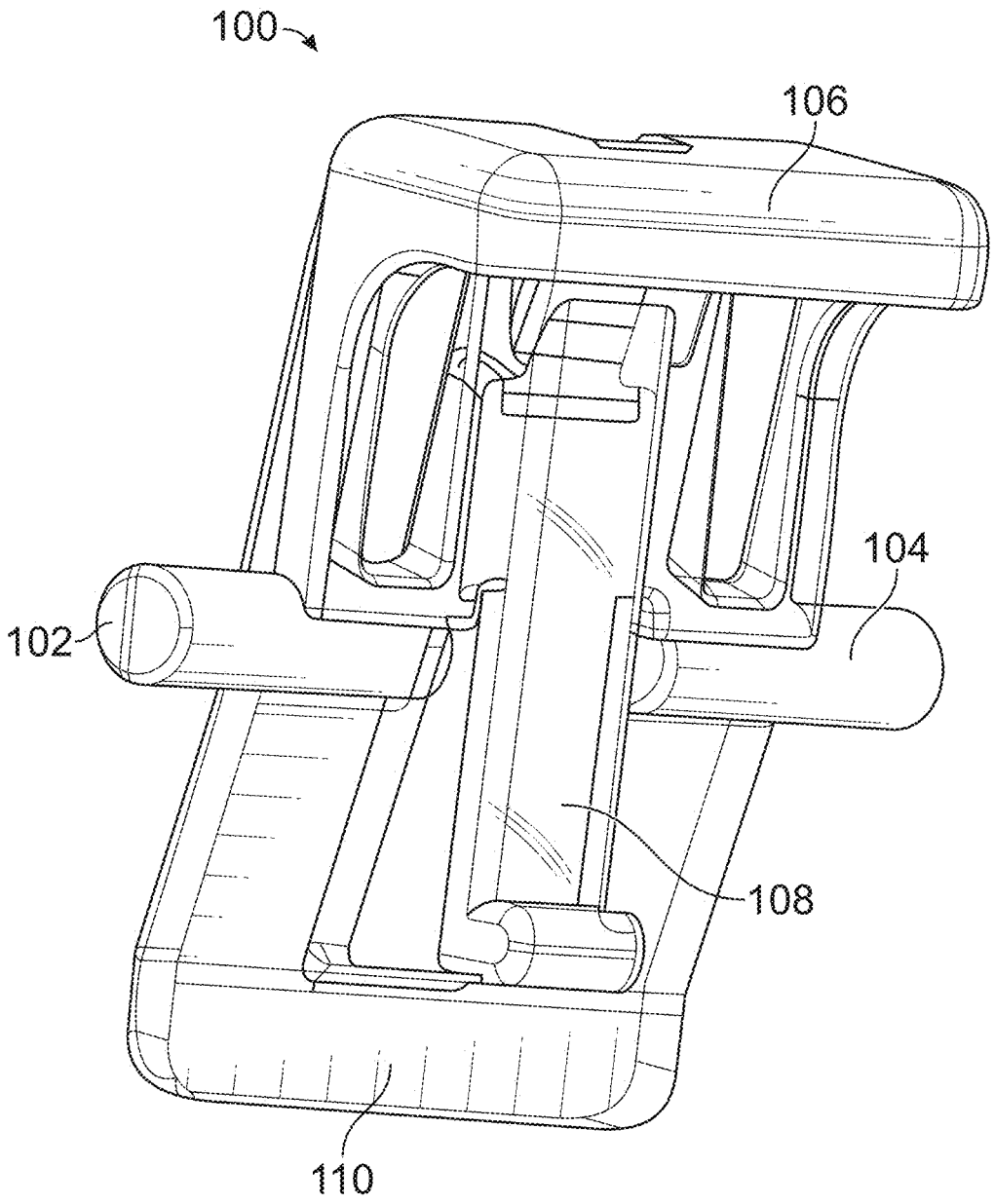
FIG. 7 is an enlarged isometric view of a rear side of the dart restrainer used with the dart magazine shown in FIGS. 3A and 4.

The dart magazine 24 may also include a mounting structure 98, FIG. 3A, on one of the sidewalls, such as the right side wall 64, to receive and mount a dart restrainer 100, FIGS. 5 and 7. The dart restrainer 100 may include integral mounting and pivot shafts 102, 104, a dart blocking portion 106, a biasing spring 108 and a lever portion 110. The dart restrainer 100 is flexible such that as the operator loads the dart magazine, the dart-blocking portion 106 of the dart restrainer 100 is initially biased inward to block or obstruct darts stacked in the magazine 24 from passing through the open top as shown in FIG. 5, but the operator is able to pivot the dart restrainer away from the magazine slot 84 to allow darts to pass into the slot 84 and be stacked as each dart is pushed downward by the operator. After each dart is put into the magazine, the biasing spring 108 pivots the blocking portion 106 of the dart restrainer 100 back into an obstructing position so that as long as the magazine is not inserted into the dart launcher 10, the darts in the magazine are secured. This allows the magazine to be loaded in the usual fashion.

Figure 8:
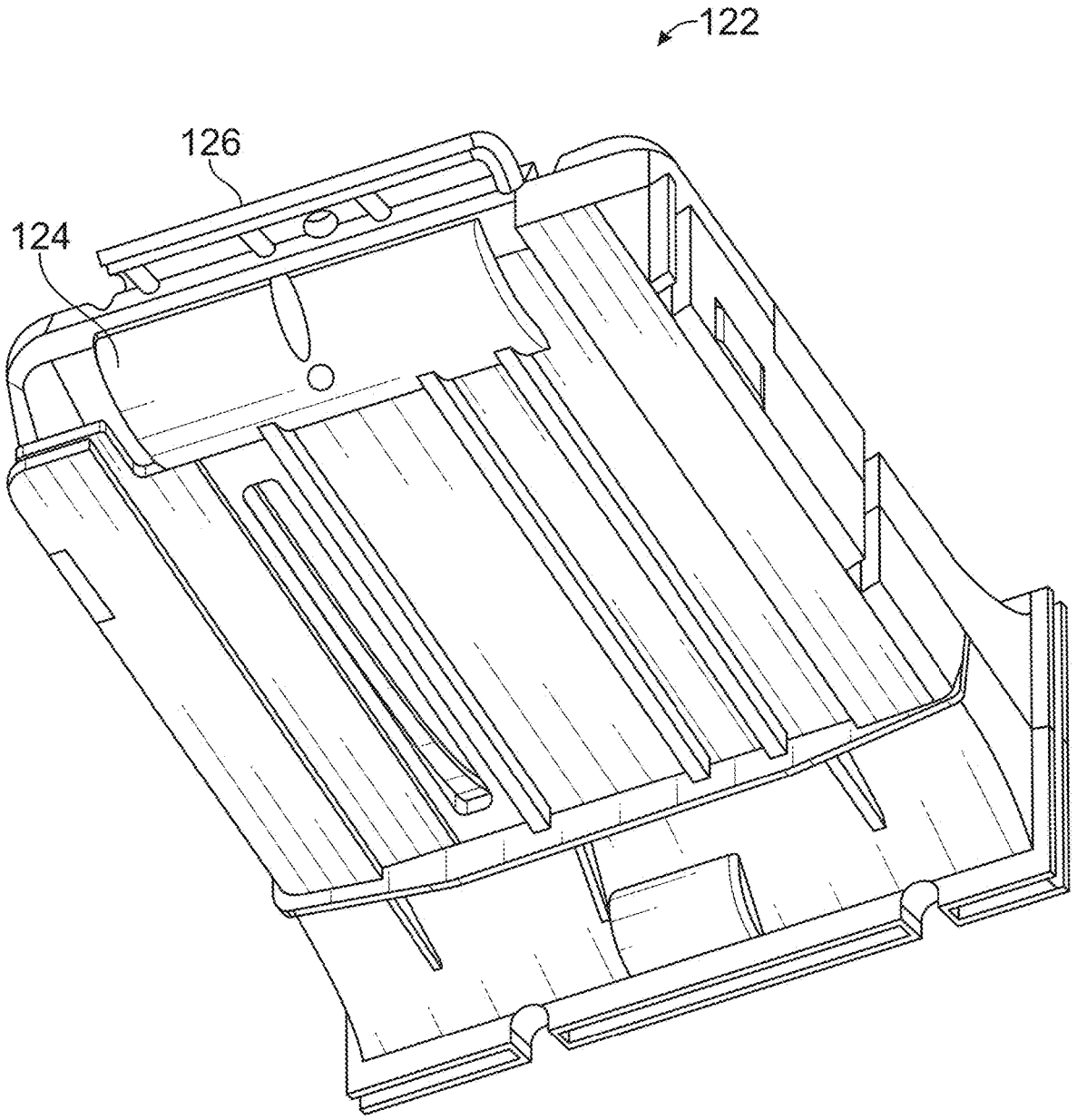
FIG. 8 (Prior Art)
FIG. 8 is an isometric view of a prior art dart magazine.

Once an operator is finished inserting one or more darts into the dart magazine 24, the magazine spring structure 74 and the follower 76 bias the dart or darts upward toward the open top 72. However, the dart restrainer 100 prevents any of the darts, such as the upper-most dart 120, FIG. 5, from leaving the magazine 24 as long as the magazine is not yet inserted into the dart launcher. It is to be noted that the magazine 24 top portion is shorter than prior art magazines, and when inserted into the dart launcher, the magazine 24 will not extend into the launch chamber 22 as is the case with a prior art magazine 122, illustrated in FIG. 8.

The prior art magazine 122 locates its upper-most dart between two curved lips or arms 124, 126, which are at a higher elevation than the open top 72 of the magazine 24, and when inserted into a launcher, the arms are located in the launch chamber of the corresponding launcher. The arms 124, 126 act to prevent the darts in the prior art magazine 122 from leaving the magazine until a launching mechanism pushes the upper-most dart forward away from the arms 124, 126 of the magazine 24.

Typically, older, worn, and/or slightly misshapen darts may cause improper firing of the dart launchers, often where a dart is held by the two curved arms 124, 126 because the upper-most and next to upper-most darts sometimes squeeze together. Sometimes, the darts get tangled with the arms 124, 126 themselves. The darts may also squeeze between the two arms 124, 126 in the narrow gap between them. When this happens it is difficult to remove the prior art magazine 122 from the dart launcher should the operator deem it advisable to remove the magazine 122 to clear the jam. These problems of dart handling are pretty much eliminated by the present invention.

Figure 9:
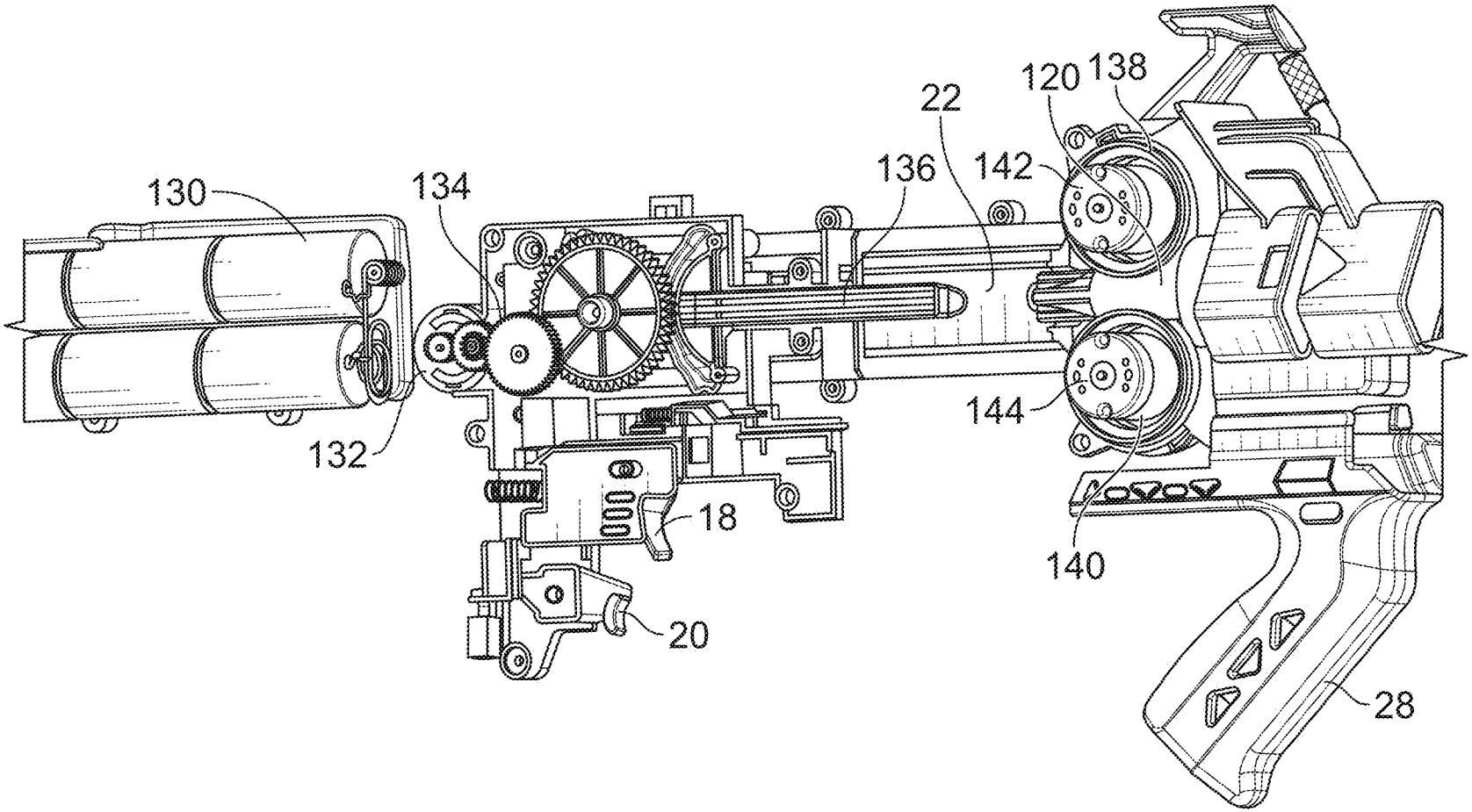
FIG. 9 is a right side isometric view of internal components of the dart launch apparatus shown in FIG. 1.

Mounted to or within the dart launcher 10, FIGS. 1 and 9, may be the trigger, one or more batteries 130, a feeder assembly including a first drive motor 132, a gear train 134, a reciprocating push rod 136, and a pair of launch wheels 138, 140 with corresponding second and third drive motors 142, 144. Attached to the housing 12 of the dart launcher 10 are the magazine lock 80, FIGS. 1, 4 and 6, and a sliding door 146, FIG. 10, to open and close an opening 148 in the launcher housing 12 adjacent the launch chamber 22, FIG. 9. The operator may use the opening 148 to clear any dart jams. The launch chamber 22 is a space in the outer housing aligned with the push rod 136 and the launch wheels 138, 140. Before a dart is launched it is positioned in the launch chamber 22 waiting to be pushed out by the push rod 136.

Figure 11:
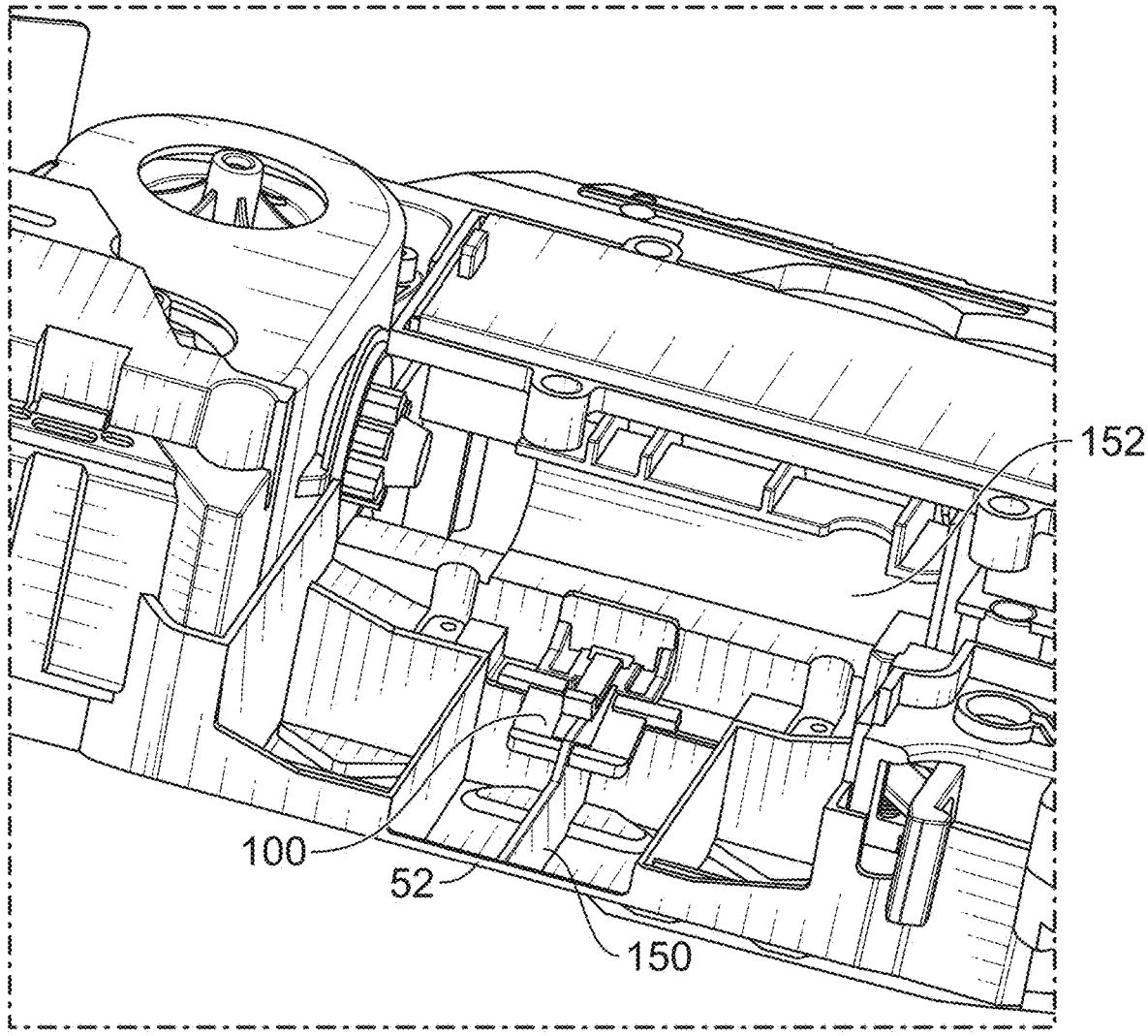
FIG. 11 is an upward looking isometric view of a portion of the dart launch apparatus shown in FIG. 10, illustrating a cam rib and a dart placement structure.
Figure 12A:
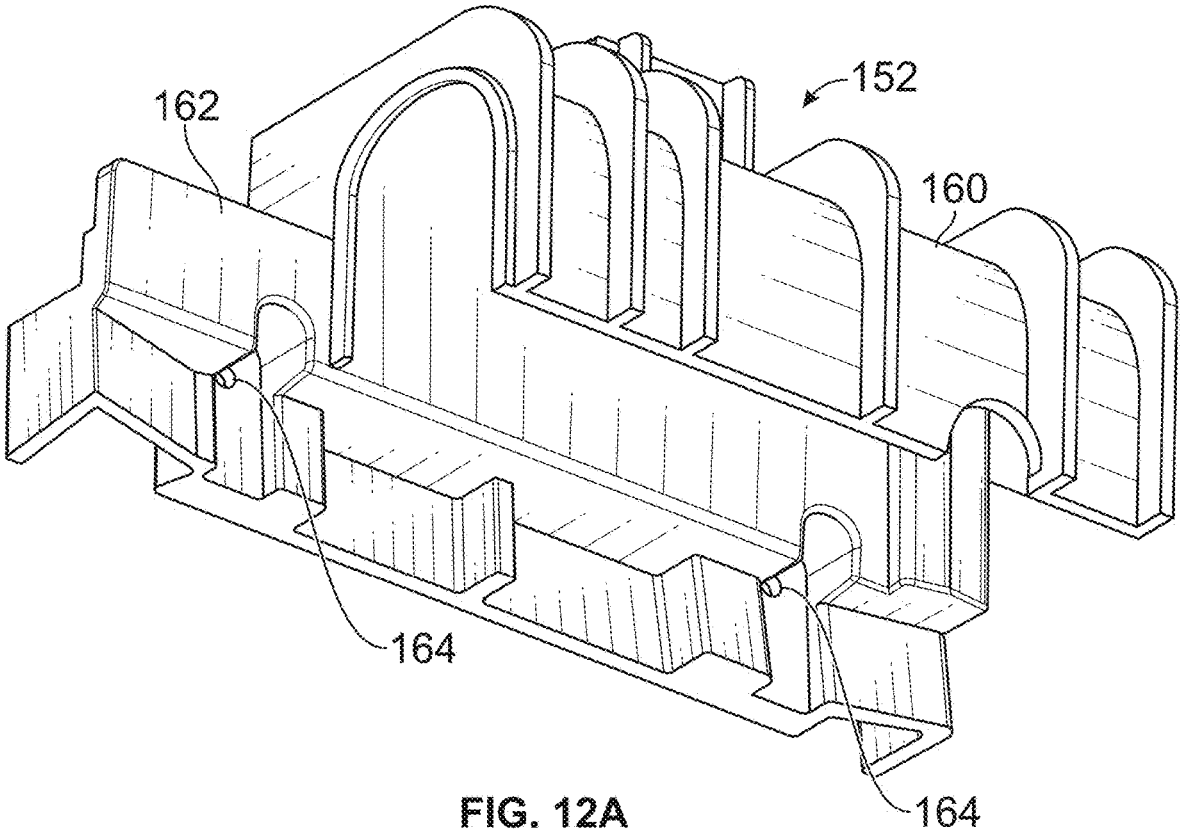
FIGS. 12A and 12B are respective isometric front and rear views of the dart placement structure shown in FIG. 11.
Figure 12B:
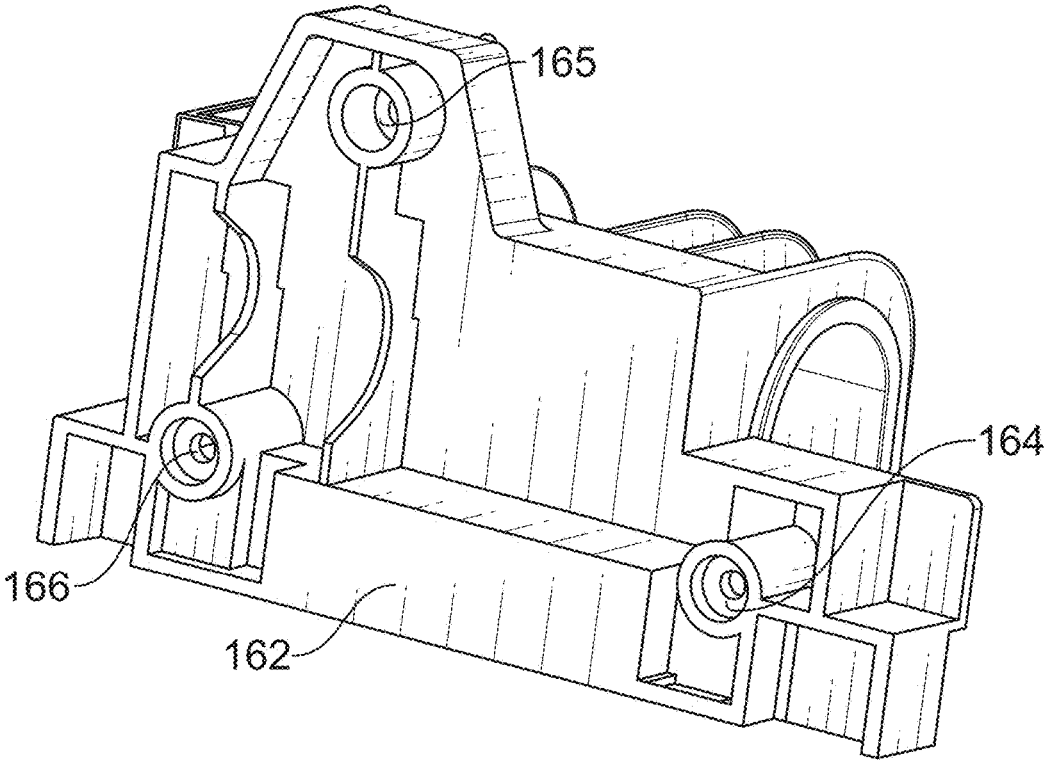
Figure 13A:
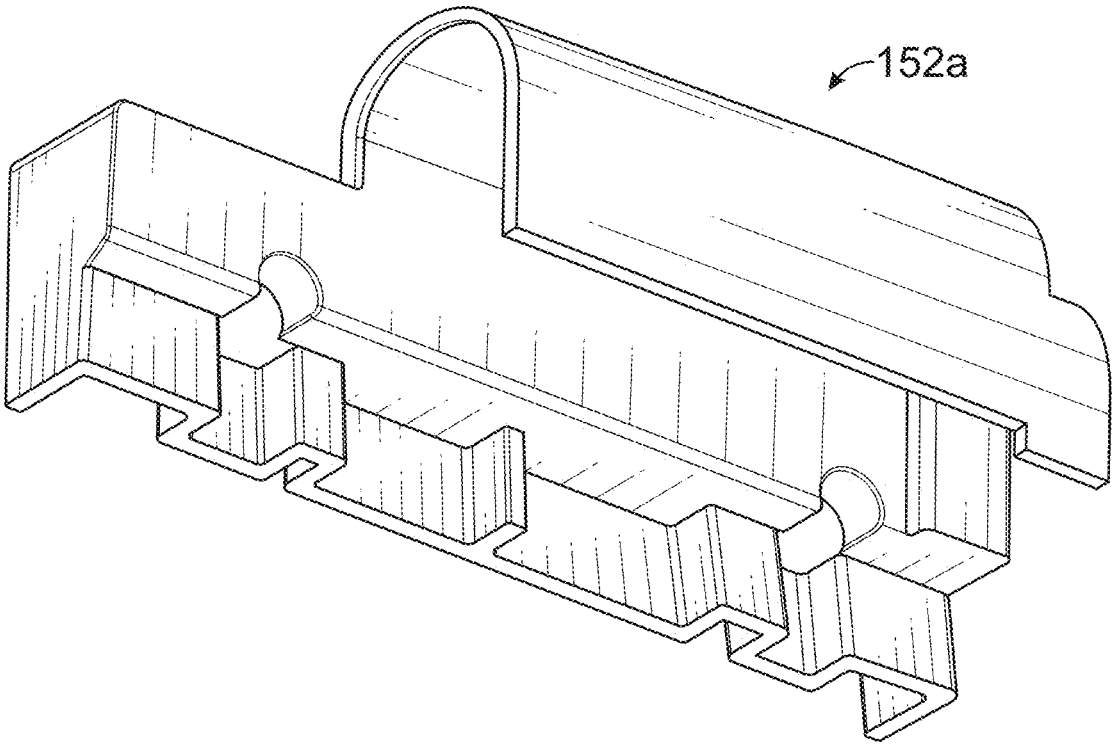
FIGS. 13A and 13B are alternative dart placement structure views for use in FIG. 11 for as dart placement structure alternative embodiments in accordance with the present inventions.
Figure 13B:
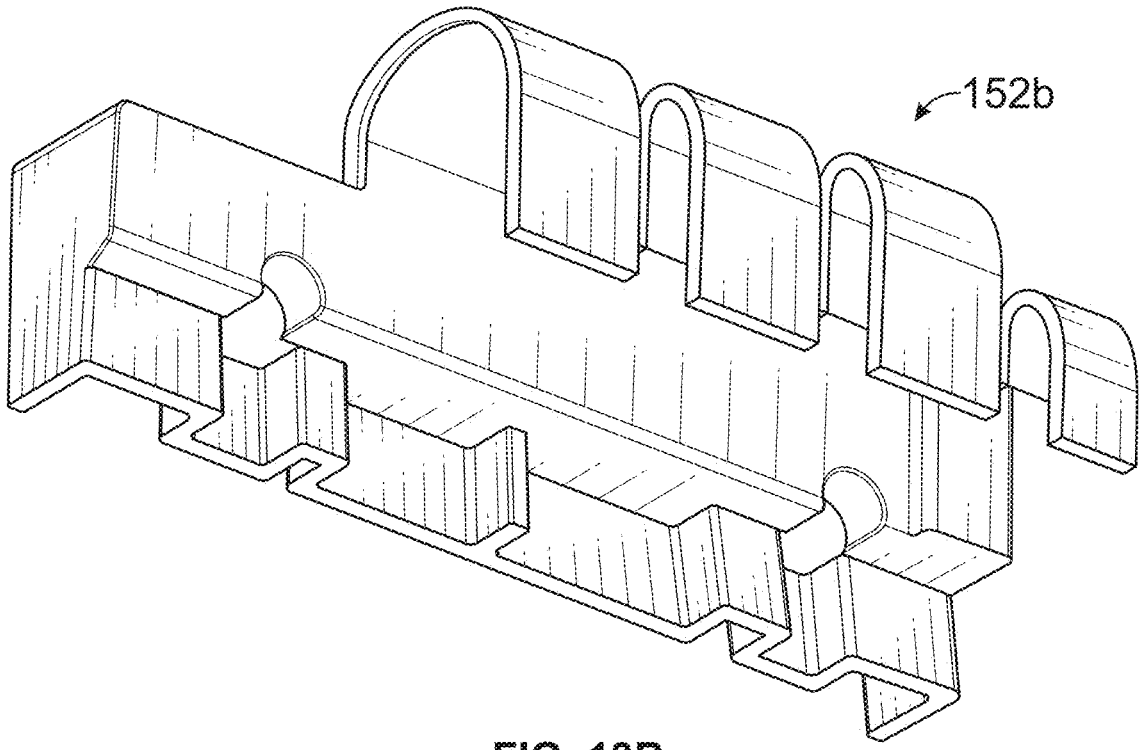

Two simple but important structures in the inventive dart launcher 10 are a cam rib 150, FIG. 11, and a dart placement structure 152, with FIGS. 12A-12B. FIGS. 12A and 12B are respective isometric front and rear views of the dart placement structure shown in FIG. 11. FIGS. 13A and 13B illustrate alternative dart placement structures with single curved contour or multiple finger elements of the nub outline for use in FIG. 11 for as dart placement structure alternative embodiments to accommodate differently shaped dart projectiles. Further, the placement structure 152, 152*a*, 152*b* profile could be altered in terms of its profile to accept a differently shaped dart that is not cylindrical but rather of a different non-cylindrical profile such as rectangular, squared off, keyed, geared, grooved or ribbed profile, elliptical or non-circular, e.g, as illustrated FIGS. 3B-3K as alternate dart profiles. The bottom of the dart launcher 10 is illustrated in FIGS. 10 and 11, where the bottom opening 52 and a side opening 148 with the sliding door 146, are shown. The cam rib 150 extends into the space to be occupied by the upper portion of the magazine 24. As the magazine 24 is fully inserted into the dart launcher 10, the right wall 64 of the magazine 24, including the dart restrainer 100, slides along the cam rib 150 causing the dart restrainer 100 to act as a cam follower and pivot. When the dart restrainer 100 pivots, the dart blocking portion 106, FIGS. 5 and 7, of the dart restrainer 100 moves away from its position preventing upward movement of the darts in the magazine. When the dart restrainer 100 releases the darts in the magazine, they are immediately biased upward by the magazine spring structure 74 resulting in the upper-most dart 120, FIG. 4, being pushed into the launch chamber 22 of the dart launcher 10, and out of the magazine 24. This is unlike the continued restraint placed on the upper-most dart of the prior art magazine 122, FIG. 8, because in the prior art magazine 122, the upper-most dart is still obstructed by the two arms 124, 126 of the magazine. Removing the two arms from the magazine obviates the problem of dart entanglement. Furthermore, should darts become jammed, there are no magazine components in the launch chamber to prevent the removal of the magazine from the launcher. These are clear advantages of the magazine 24 and launcher 10 combination disclose herein.

Figure 4:
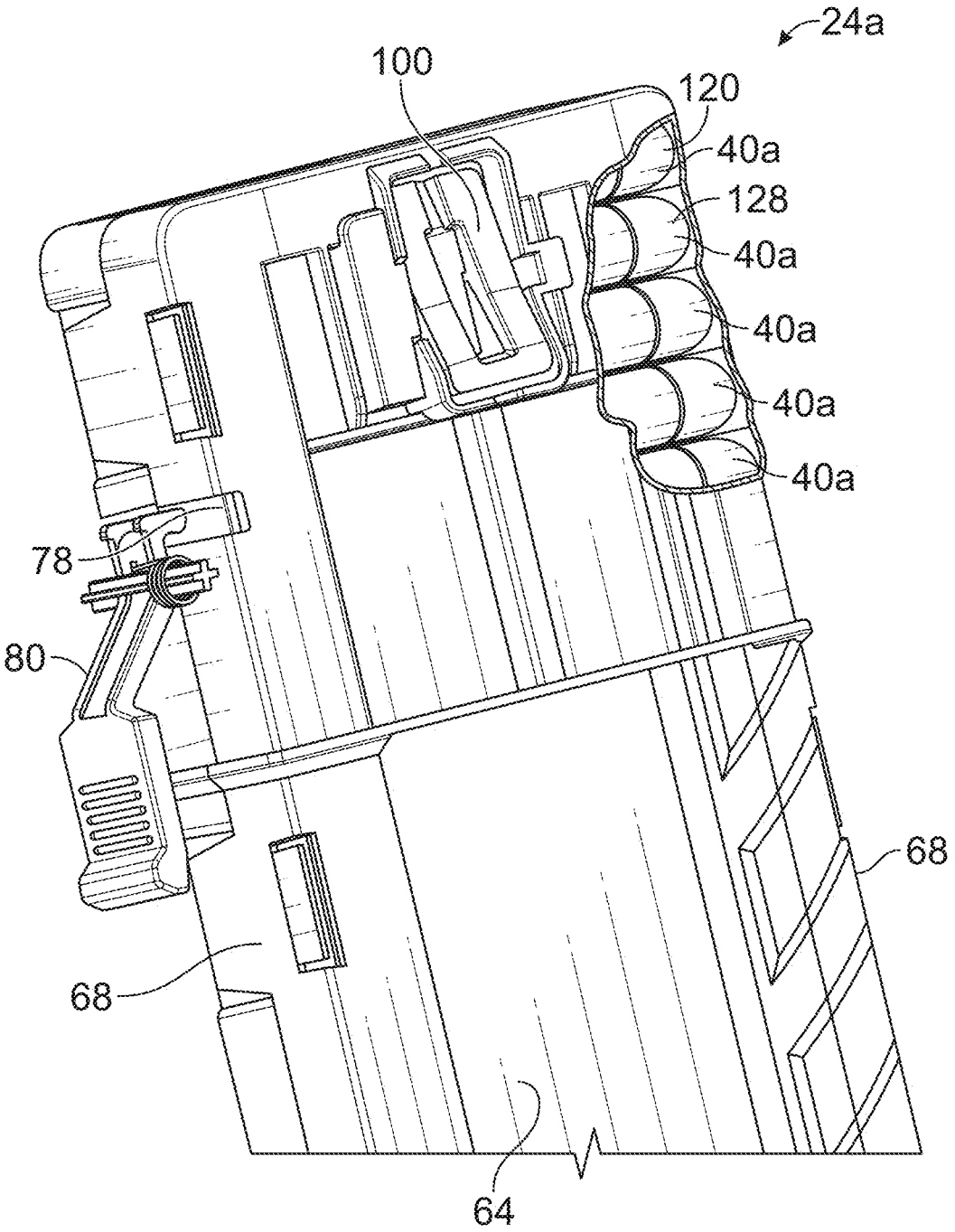
FIG. 4 is an elevation view of the dart magazine shown in FIG. 3A, with a cutout to illustrate darts carried by the dart magazine. The view also shows the front of a dart restrainer.
Figure 14:
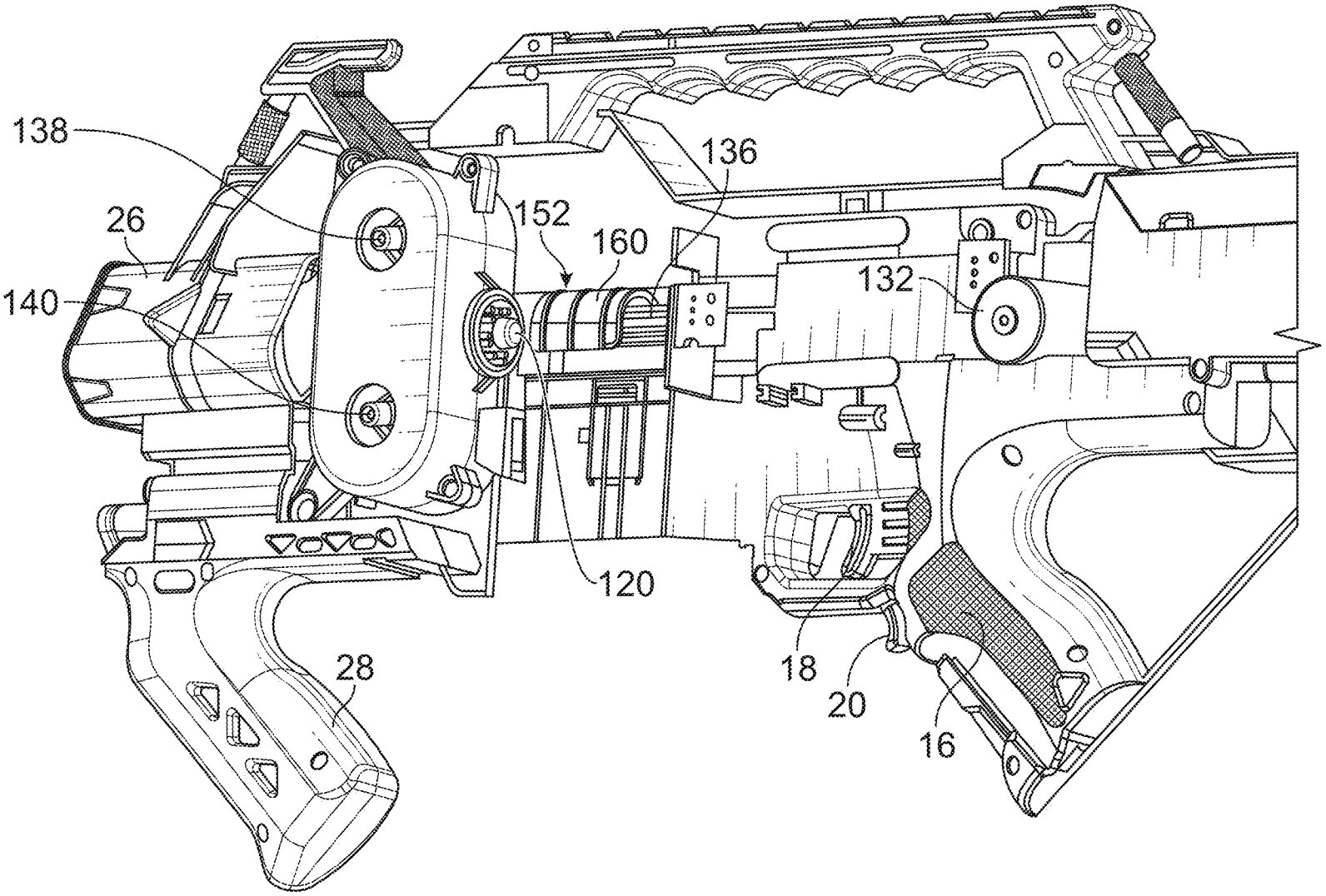
FIG. 14 is a left side isometric view of the dart placement structure shown in FIGS. 12A and 12B, mounted in the launch chamber above the dart magazine and illustrating a dart being pushed by a reciprocating push rod into a gap between two launch wheels.

Within the launch chamber 22, and ready to receive the upper-most dart 120 is the other important structure, the dart placement structure 152, 152*a*, 152*b*, FIGS. 11-13B. The dart placement structure 152 may be formed with the housing 12 or may be mounted to interior of the housing 12. The dart placement structure 152 may be a shaped arm such as a semicircular arm 160 and be integral with a mounting bracket 162 having three screw holes 164, 165, 166. The semi-circular arm 160 is positioned in the launch chamber 22 just above the magazine 24, when the magazine is inserted, such that the upper-most dart 120 is lodged against the dart placement structure 152, 152*a*, 152*b* and aligned with the reciprocating pusher rod 136 and the launch wheels 138, 140. The dart 120 is also free of the magazine 24 facilitating automatic firing of darts 40. The alignment allows the pusher rod 136 to shove the upper-most dart 120 from the launch chamber 22 into a gap between the two wheels 138, 140 as shown in FIGS. 9 and 14, where the dart 120 is illustrated in the gap. When the wheels are spinning, the dart 120 is immediately launched and the next upper-most dart 128, FIG. 4, is lodged in the launch chamber 22 up against the dart placement structure 152. All this happens automatically when both launch trigger 18 and a power trigger 20 are depressed.

The jamming or dart forward orientation placement concerns are alleviated with a forward matching dart profile used with the dart magazine 24 and dart launcher 10. By removing the gripping structure at the top of a magazine there is substantially less chance of having two or more darts squeezing together. The dart placement structure 152 is mounted within the launch chamber 22 of the dart launcher 10, and is not part of the magazine. The location of the dart placement structure removes the opportunity of a misshapen dart squeezing into the gap between the two arms 124, 126 of the prior art magazine 122. As a single component, the dart placement structure 152 does not allow for any gap and leaves very little structure for a dart to snag or get caught on within the launch chamber 22. Also, the inventive magazine 24 has no such upper components so that removing the magazine is easily accommodated. Moreover, the dart placement structure 152 is located just beyond the sliding door 146, which allows for easy access to the area of the launch chamber 22, and should there be a jam, the operator has an alternative to clear any jam that does occur.

In the alternative, the dart placement structure may have one or more planar shaped panels instead of the semicircular arm 160 of a different shape, or the dart placement structure may include two or more spaced apart curved tabs instead of the semicircular arm. The additional advantage here is that the dart placement structure may have any suitable shape, such as one conforming to a new dart design. Hence, even if the dart placement structure is altered, there would be no need to modify the dart launcher 10. The design of the dart placement structure may also have an accommodation for the nub 50, for example, thereby acting as another safety feature for the dart launcher so that the launcher does not accept non-complying objects for discharge. Also in the alternative, the energy source for lunching darts may come from a launch spring instead of an assembly of batteries, a gear train, a push rod, launch wheels and motors.

In operation after the dart magazine 24 is loaded with one or more darts, the magazine is inserted into the dart launcher. First, the magazine 24 will only extend into the launcher to have the lock 80 engage in the recess 78. Thus, the magazine does not enter the launch chamber 22 as did the prior art magazine 122. Second, as the magazine nears a full insertion, the cam rib 150 pivots the dart restrainer 100 such that the upper-most dart 120 is biased into the launch chamber. When this happens the upper-most dart 120 is no longer attached to or in the magazine 24. The upper-most dart is in the launcher 10 and is aligned with the push rod 136 and the launch wheels 138, 140.

Once the upper-most dart is in the launch chamber 22, the operator may aim the dart launcher at a target and depresses the power trigger and the launch trigger. Depressing the triggers cause the one or more batteries to provide energy to the second and third drive motors to spin the launch wheels and provide energy to the first drive motor to energize the gear train. The gear train reciprocates the push rod to move the upper-most dart, located by the dart placement structure 152, to the launch wheels as shown in FIGS. 9 and 14. If the launch trigger is not released, the push rod continues to move darts to the launch wheels resulting in a launcher with a very rapid discharge of darts. When the operator depresses the launch trigger sequentially, the launcher will discharge darts at a slower rate corresponding to the trigger pull. Or, the operator may depress the launch trigger just once for a single dart discharge.

It is noted that throughout this detailed description, words such as "forward," "rearward," "upper," "lower," "front," "rear," "top" and "bottom," as well as similar positional terms, refer to portions or elements of the launcher as they are viewed in the drawings, or in relationship to the positions of the apparatus as it will typically be deployed and moved during use, or to movements of elements based on the configurations illustrated.

Figure 15:
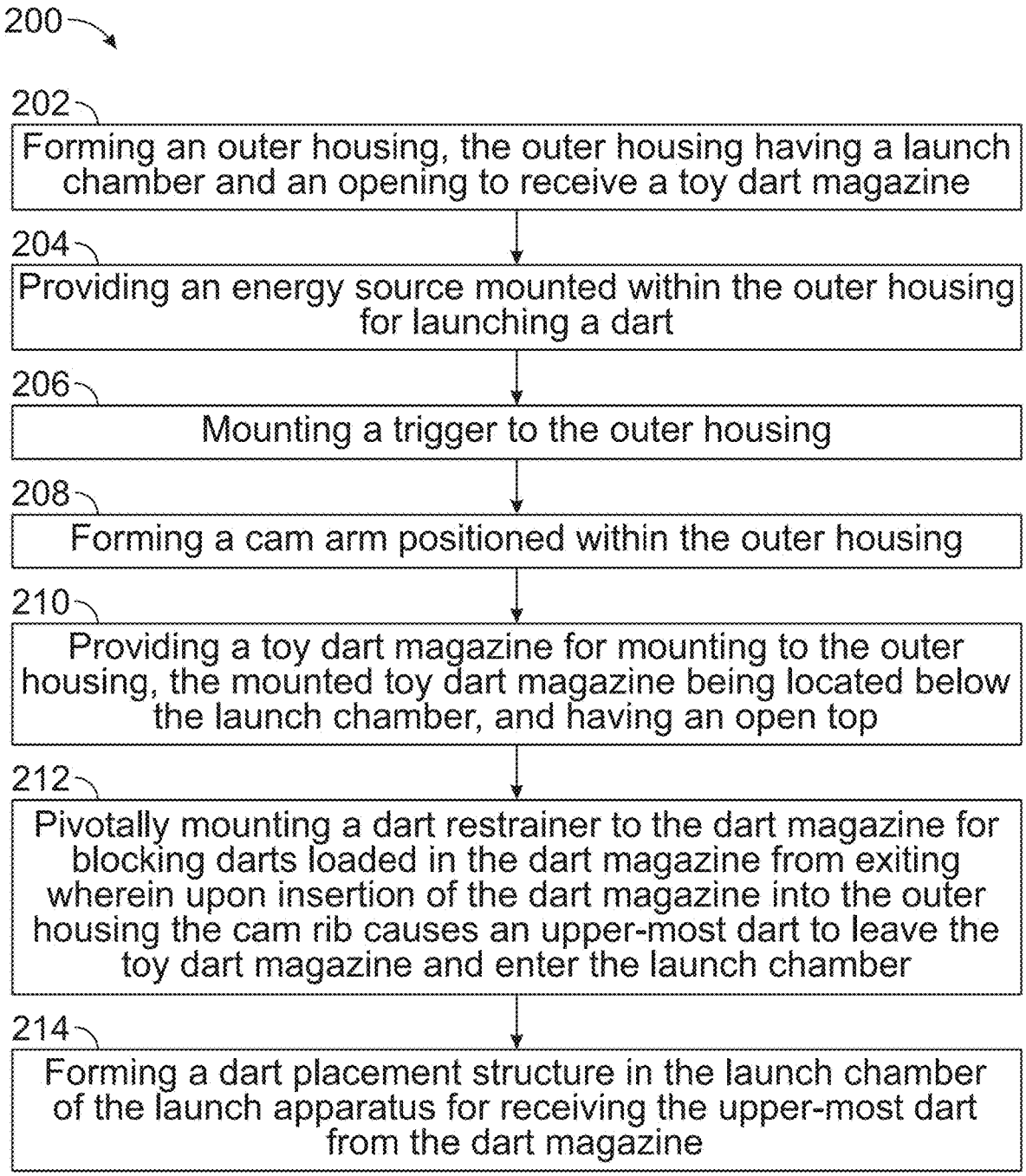
FIG. 15 is a flow chart of a method for making the dart launch apparatus.

The present invention includes a method 200, FIG. 15, for making a dart launch apparatus including the steps of forming an outer housing, the outer housing having a launch chamber and an opening to receive a dart magazine 202, providing an energy source mounted within the outer housing for launching a dart 204, mounting a trigger to the outer housing 206, forming a cam arm positioned within the outer housing 208, providing a dart magazine for mounting to the outer housing, the mounted dart magazine being located below the launch chamber, and having an open top 210, pivotally mounting a dart restrainer to the dart magazine for blocking darts loaded in the dart magazine from exiting wherein upon insertion of the dart magazine into the outer housing the cam rib causes an upper-most dart to leave the dart magazine and enter the launch chamber 212, and forming a dart placement structure in the launch chamber of the launch apparatus for receiving the upper-most dart from the dart magazine 214.

From the foregoing, it can be seen that there has been provided a detailed description of features for an improved dart launch apparatus as well as a disclosure of a method for assembling the dart launch apparatus. While particular embodiments of the present invention has been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A dart magazine for operating with a dart launch apparatus, the dart launch apparatus having a launch chamber, the dart magazine comprising:

a magazine housing for receiving a plurality of darts, the magazine housing having two sidewalls, a front wall, a rear wall, a bottom wall and an open top;

a dart follower movable in the magazine housing;

a spring structure positioned between the bottom wall and the dart follower for biasing darts in the magazine housing to the open top; and a dart restrainer mounted to the magazine housing for blocking and unblocking biased darts at the open top wherein with the magazine inserted into the dart launch apparatus an unblocked dart leaves the dart magazine.

2. The dart magazine claimed in claim 1, wherein the dart restrainer comprises one or more lever and pivot shafts mounted to the magazine housing.

3. The dart magazine claimed in claim 2, wherein:

when the magazine housing is separated from the dart launch apparatus the dart restrainer blocks the dart from moving through the open top until the dart magazine is inserted into the dart launch apparatus.

4. The dart magazine claimed in claim 2, including:

a border structure positioned around the open top of the dart magazine for inducing the loading of darts into the magazine housing in only one direction.

5. The dart magazine claimed in claim 2, wherein:

the dart restrainer is positioned on the magazine housing to slide against a cam rib in the dart launch apparatus when the magazine housing is inserted into the dart launch apparatus.

6. A dart launch apparatus comprising:

an outer housing, the outer housing having an opening to receive a dart magazine and a launch chamber located in the opening;

an energy source mounted in the outer housing for launching a dart;

a trigger mounted to the outer housing for causing a dart to be launched;

a dart magazine removably mounted to the outer housing through the opening in the outer housing, the dart magazine including a magazine housing having an open top;

a dart restrainer mounted to the magazine housing for blocking and unblocking biased darts at the open top wherein with the magazine inserted into the dart launch apparatus an unblocked biased dart at the open top of the dart magazine housing is biased into a launch chamber of the dart launch apparatus; and a dart placement structure within the launch chamber for receiving an upper-most dart from the dart magazine when the dart magazine is inserted into the outer housing.

7. The dart launch apparatus claimed in claim 6, comprising a cam rib in the outer housing positioned between the launch chamber and the dart magazine opening for the unblocked biased dart positioning into the launch chamber.

8. The dart launch apparatus claimed in claim 7, wherein the dart restrainer is moved by the cam rib when the dart magazine is inserted through the opening in the outer housing.

9. The dart launch apparatus claimed in claim 6, wherein:

a border structure positioned around the open top of the dart magazine for inducing the loading of darts into the magazine housing in only one direction.

10. The dart launch apparatus claimed in claim 9, wherein:

the dart placement structure is mounted in the launch chamber above the open top of the dart magazine.

11. The dart launch apparatus claimed in claim 10, wherein:

the dart placement structure receives darts that have left the dart magazine.

12. The dart launch apparatus claimed in claim 11, wherein:

the dart placement structure is a shaped arm.

13. The dart launch apparatus claimed in claim 6, wherein:

the dart restrainer is flexible with an integral dart blocking portion and a tail portion.

14. The dart launch apparatus claimed in claim 13, wherein:

the dart restrainer is positioned on the magazine housing to slide against a cam rib in the dart launch apparatus when the magazine housing is inserted into the dart launch apparatus, the cam rib is positioned to pivot the tail.

15. The dart launch apparatus claimed in claim 6, wherein:

the outer housing includes an opening adjacent the launch chamber; and including a sliding door for covering the adjacent launch chamber opening.

16. A method for making a dart launch apparatus comprising the steps of:

forming an outer housing, the outer housing having a launch chamber and an opening to receive a dart magazine;

providing an energy source mounted within the outer housing for launching a dart;

mounting a trigger to the outer housing for causing a dart to be launched;

providing a dart magazine removably mounted to the outer housing through the opening in the outer housing, the dart magazine including a magazine housing having an open top;

mounting a dart restrainer to the magazine housing for blocking and unblocking biased darts at the open top wherein with the magazine inserted into the dart launch apparatus an unblocked biased dart at the open top of the dart magazine housing is biased to leave the dart magazine and enter the launch chamber; and forming a dart placement structure within the launch chamber for receiving an upper-most dart from the dart magazine when the dart magazine is inserted into the outer housing.

17. The method claimed in claim 16, wherein:

when the magazine housing is separated from the dart launch apparatus the dart restrainer blocks the dart from moving through the open top until the dart magazine is inserted into the dart launch apparatus.

18. The method claimed in claim 16, including the step of:

mounting one or more lever and pivot shafts to the dart magazine housing for blocking darts loaded in the dart magazine from exiting.

19. The method claimed in claim 18, including the step of:

forming a cam rib positioned within the outer housing, wherein upon insertion of the dart magazine into the outer housing the cam rib causes an upper-most dart to leave the dart magazine and enter the launch chamber.

20. The method claimed in claim 18, including the step of:

forming a border around the open top of the dart magazine that induces the loading of darts in the dart magazine in the correct direction.

* * * * *